US005370233A

United States Patent [19]

Schutz et al.

[11] Patent Number: 5,370,233

[45] Date of Patent: Dec. 6, 1994

[54] PRODUCT SHIPPING AND DISPLAY SYSTEM

[75] Inventors: Rudolph W. Schutz, Walnut Creek; Lawrence E. Weinert, Antioch, both of Calif.

[73] Assignee: James River Paper Company, Inc., Richmond, Va.

[21] Appl. No.: 189,653

[22] Filed: Feb. 1, 1994

[51] Int. Cl.[5] ..... B65D 19/00; B65D 5/02

[52] U.S. Cl. ..... 206/597; 206/386; 206/600; 229/23 BT

[58] Field of Search ..... 206/386, 597, 600; 229/23 BT

[56] References Cited

U.S. PATENT DOCUMENTS

| | | | |
|---|---|---|---|
| 3,167,179 | 1/1965 | Goldstein | 229/23 BT |
| 3,291,364 | 12/1966 | Fischer | 206/600 |
| 3,315,435 | 4/1967 | Gunyou . | |
| 3,858,526 | 1/1975 | Lombard et al. . | |
| 3,878,943 | 4/1975 | Ryan et al. | 206/497 |
| 4,079,566 | 3/1978 | Stoecklin . | |
| 4,095,692 | 6/1978 | Shelton | 206/386 |
| 4,454,946 | 6/1984 | Yokowo | 206/600 |
| 4,567,981 | 2/1986 | Headon | 206/597 X |
| 4,799,350 | 1/1989 | Rias . | |
| 4,821,491 | 4/1989 | Rias . | |
| 4,919,270 | 4/1990 | Govang et al. | 206/597 |
| 5,215,248 | 6/1993 | Moser | 206/600 X |
| 5,332,085 | 7/1994 | Fraser | 206/597 X |

FOREIGN PATENT DOCUMENTS

| | | | |
|---|---|---|---|
| 2604189 | 8/1977 | Germany | 206/600 |
| 2212472 | 7/1989 | United Kingdom | 206/597 |

*Primary Examiner*—William I. Price

*Attorney, Agent, or Firm*—Thomas R. Lampe

[57] ABSTRACT

A product shipping and display assembly includes a tray, a sleeve element positioned in the tray and a plurality of packages stacked in the sleeve element on the tray. The sleeve element has rear and side walls. The sleeve element side walls curve or bow outwardly to increase the columnar loading strength of the sleeve element. A plurality of assemblies can be positioned on a pallet and separately removed from the pallet.

11 Claims, 5 Drawing Sheets

PRODUCT SHIPPING AND DISPLAY SYSTEM

TECHNICAL FIELD

This invention relates to an assembly for transporting to and displaying at point of purchase a plurality of products, for example, packages of paper towels, tissue rolls and the like.

BACKGROUND ART

It is known to provide assemblies which are utilized to both transport and provide point of purchase merchandizing capabilities. U.S. Pat. No. 4,919,270, issued Apr. 24, 1990, for example, discloses a transport and merchandizing assembly consisting of a multiplicity of package modules stacked upon pallets, several of which are in turn disposed upon the support surface of a skid. The stacks are independently secured to provide separate subassemblies which in turn are also secured to the skid. Other patents considered representative of the prior art are the following U.S. Pat. Nos. 4,079,566, issued Mar. 21, 1978, 3,858,526, issued Jan. 7, 1975, 4,799,350, issued Jan. 24, 1989, 4,821,491, issued Apr. 18, 1989, 4,567,981, issued Feb. 4, 1986, 3,878,943, issued Apr. 22, 1975, and 3,315,435, issued Apr. 25, 1967.

DISCLOSURE OF INVENTION

An increasing number of retail outlets for paper towels, tissues and other packaged consumer products display such products in their shipping cartons for retrieval and purchase by a consumer. This is to be compared with the more conventional merchandizing practice of displaying packaged products on shelves after completely removing them from their shipping containers. Many mass merchandisers currently receive products by the pallet load. The option is presented of either selling the packaged products directly from the pallet or from individual modular containers (each containing a plurality of packages) which can be removed separately from the pallet and placed at point of purchase.

The present invention relates to a product shipping and display system wherein a plurality of individual product shipping and display assemblies can be transported on a single pallet. The assemblies may be left on the pallet for display and product sale or the assemblies may be readily removed and displayed on an individual basis.

The product shipping and display assembly is characterized by its relatively low cost as well as by its strength and durability both during shipment with a plurality of other like assemblies on a pallet or when it is free standing at the point of product purchase. Very little manual effort is required to transform the product shipping and display assembly from transport mode to display mode.

The product shipping and display assembly of the present invention includes a tray formed of sheet material including a bottom wall of rectangular configuration having a front edge, a rear edge, and two spaced side edges extending between the front edge and the rear edge.

A front tray wall extends along the length of the front edge and projects upwardly from the front edge. A rear tray wall extends along the length of the rear edge and projects upwardly from the rear edge. Spaced tray side walls extend along the lengths of the side edges and project upwardly from the side edges, the spaced tray side walls interconnecting the front and rear tray walls at four corners and defining a tray interior therewith.

A sleeve element having upper and lower open ends and formed of sheet material is positioned in the tray interior with the lower end of the sleeve element in engagement with the tray bottom wall. The sleeve element includes a sleeve element rear wall in engagement with the rear tray wall and two spaced sleeve element side walls extending outwardly from the sleeve element rear wall and along the side tray walls to define a substantially U-shaped sleeve element cross-sectional configuration and a front sleeve element opening extending between the upper and lower ends.

The sleeve element rear wall is shorter than the rear tray wall whereby the sleeve element side walls extend outwardly from the sleeve element rear wall at locations spaced inwardly from the corners defined by the rear tray wall and the side tray walls.

The sleeve element side walls have distal ends defining the front sleeve element opening extending to locations at the front tray wall spaced inwardly from the tray corners defined by the side tray walls and the front tray wall.

The sleeve element side walls curve outwardly between the sleeve element rear wall and the sleeve element side wall distal ends into engagement with the side tray walls to increase the columnar loading strength of the sleeve element.

A plurality of packages are stacked in the sleeve element on the bottom tray wall and extend upwardly from the bottom tray wall along the front sleeve element opening.

A plurality of product shipping and display assemblies are positioned on a pallet. A top cap of unitary construction including an upper cap wall extends over the pallet and over all of the product and shipping and display assembly sleeve elements positioned on trays on the pallet. The top cap has side cap walls depending from the upper cap wall and encompassing the sleeve elements of all the product shipping and display assemblies positioned on the trays on the pallet.

An overwrap at least partially encompasses all of the product shipping and display assemblies and maintains the product shipping and display assemblies in engagement with each other and the top cap on the sleeve elements of the product and shipping display assemblies.

Other features, advantages, and objects of the present invention will become apparent with reference to the following description and accompanying drawings.

BEST MODE FOR CARRYING OUT THE INVENTION

Figure 2:
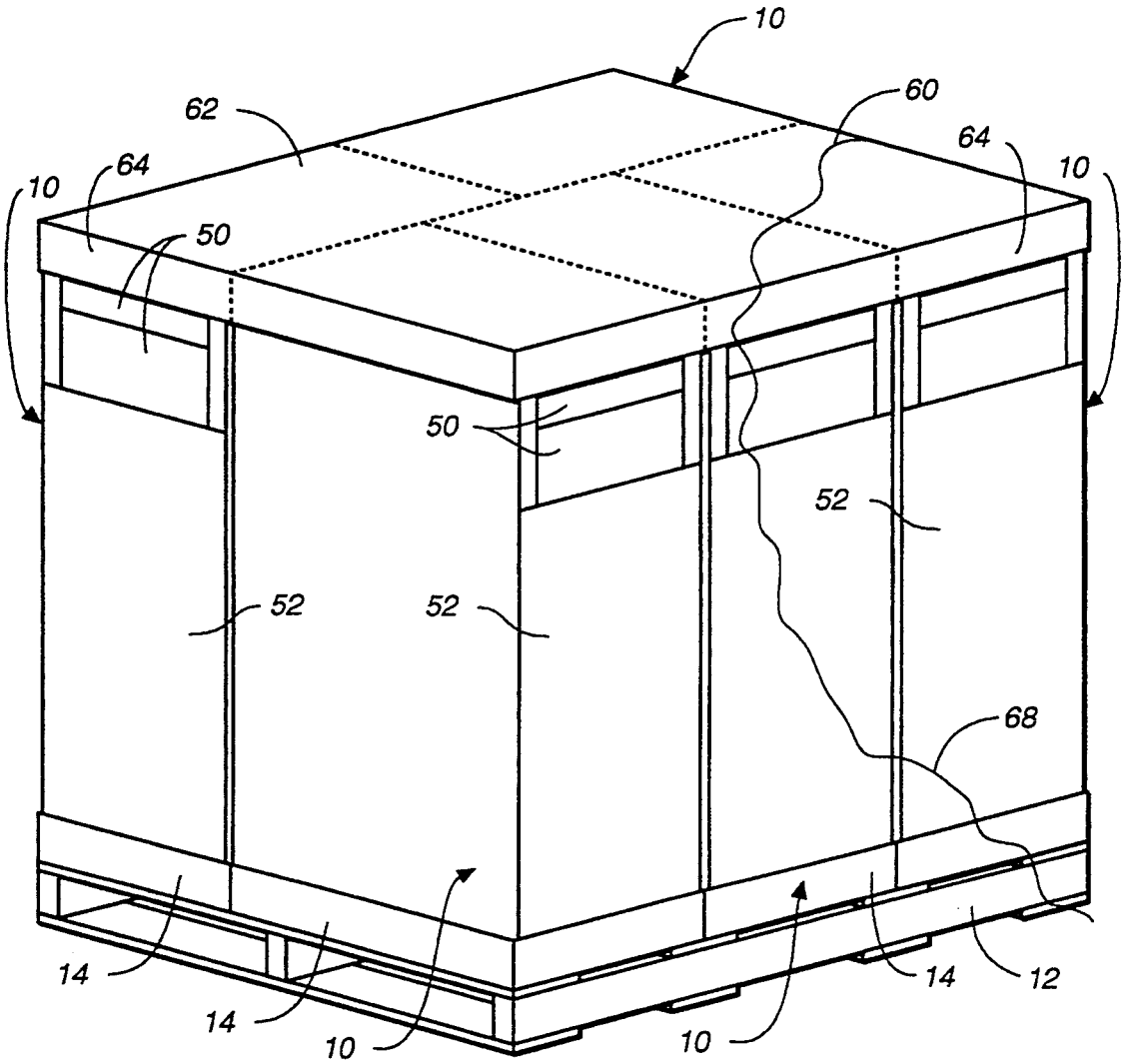
FIG. 2 is a perspective view illustrating a plurality of product shipping and display assemblies constructed in accordance with the teachings of the present invention positioned on a pallet and including a unitary top cap.

FIG. 2 of the drawings illustrates a palletized load including five product shipping and display assemblies 10 constructed in accordance with the teachings of the present invention positioned on a pallet 12, the pallet being of conventional construction.

Referring now to all of the drawing figures, the shipping and display assembly 10 includes a tray 14 constructed of paperboard or other suitable sheet material. The tray 14 includes a bottom wall 16 of rectangular configuration and having a front edge, a rear edge and two spaced side edges extending between the front edge and the rear edge.

A front tray wall 18 extends along the length of the front edge and projects upwardly from the front edge. A rear tray wall 20 extends along the length of the rear edge and projects upwardly from the rear edge. Spaced tray side walls 22, 24 extend along the lengths of the side edges and project upwardly from the side edges. The spaced tray side walls interconnect the front and rear tray walls at four corners and define a tray interior therewith.

A sleeve element 30 formed of sheet material such as paperboard has an upper open end 32 and a lower open end 34. The sleeve element is positioned in the tray interior with the lower end 34 in engagement with tray bottom wall 16.

Figure 4:
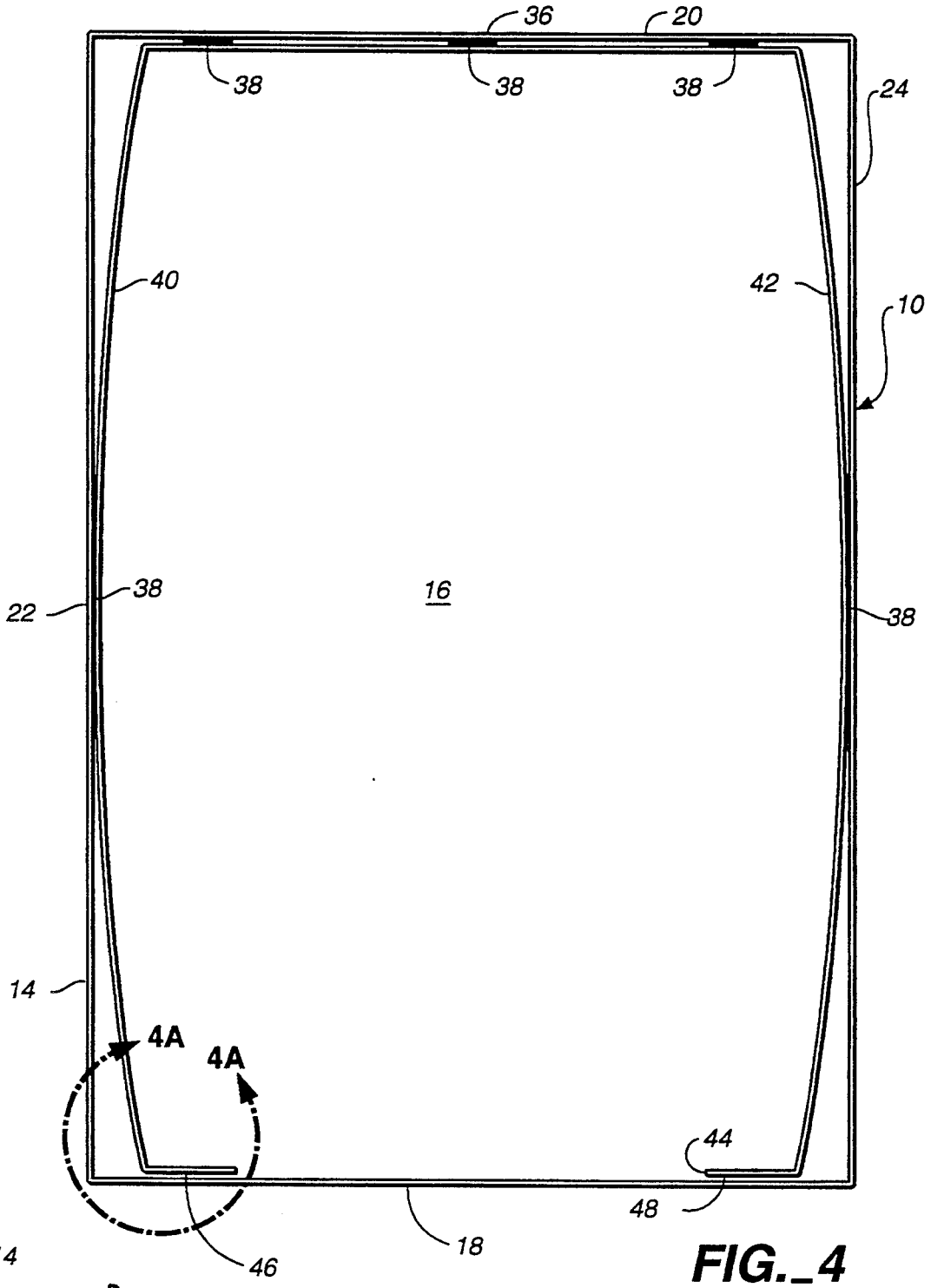
FIG. 4 is a schematic, plan view of a tray and sleeve element of the product shipping and display assembly and illustrating the relative positioning thereof.

Sleeve element 30 includes a sleeve element rear wall 36. The sleeve element rear wall 36 is in engagement with rear tray wall 20 and secured thereto by adhesive 38 as shown in FIG. 4 in somewhat exaggerated fashion. In FIG. 4 the adhesive 38 is applied at three locations. However, the number and positions of adhesive application can vary. In FIG. 4, in order to illustrate the adhesive 38 the sleeve element rear wall 36 is shown slightly spaced from the rear tray wall; however, it will be appreciated that in actuality the walls are substantially engaged.

Sleeve element 30 also includes two spaced sleeve element side walls 40, 42. Walls 40, 42 extend outwardly from sleeve element rear wall 36 and along side walls 22, 24 of the tray 14. The sleeve element rear wall and the sleeve element side walls define a substantially U-shaped sleeve element cross-sectional configuration and a front sleeve element opening 44 extending between upper and lower ends 32, 34.

The sleeve element rear wall 36 is shorter than the rear wall 20 of the tray whereby the sleeve element side walls extend outwardly from the sleeve element rear wall at locations spaced inwardly from the corners defined by the rear tray wall and the side tray walls.

The sleeve element side walls have distal ends 46, 48 in the form of inwardly directed flanges which define the front sleeve element opening 44 and extend to locations at the front tray wall 18 spaced inwardly from the tray corners defined by the side tray walls and the front tray walls.

An important feature of the present invention resides in the fact that the sleeve element side walls 40, 42 curve outwardly between the sleeve element rear wall and the sleeve element side wall distal ends into engagement with the side tray walls. This configuration increases the columnar loading strength of the sleeve element, a feature which is quite important, particularly when stacking occurs as is commonly the case with palletized unit loads.

Adhesive 38 is applied between the tray side walls and the sleeve element side walls at the point of engagement. A plurality of packages 50 are stacked in the sleeve element on the bottom tray wall and extend upwardly from the bottom tray wall along the front sleeve element opening 44.

Figure 1:
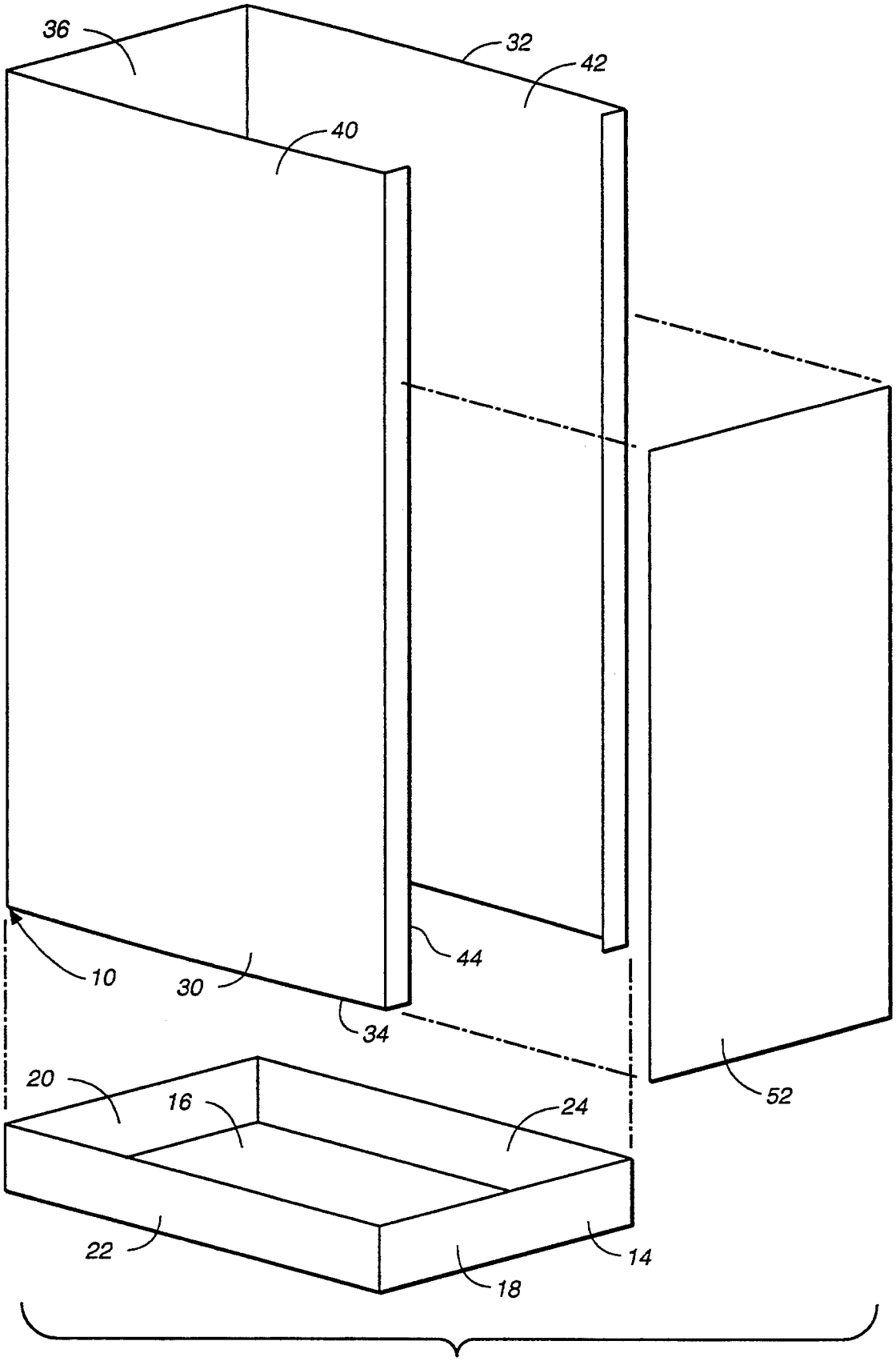
FIG. 1 is a somewhat schematic, perspective, exploded view illustrating components of the product shipping and display assembly of the present invention.

A sleeve front wall 52 is removable connected to the sleeve element side wall distal ends to cover most of the front sleeve element opening. The sleeve front wall 52 (shown in FIGS. 1, 2 and 4A only) may be secured to the distal ends or flanges 46, 48 by any suitable expedient. For example, a conventional adhesive-backed tape (not shown) may be utilized for such purpose.

Figure 4A:
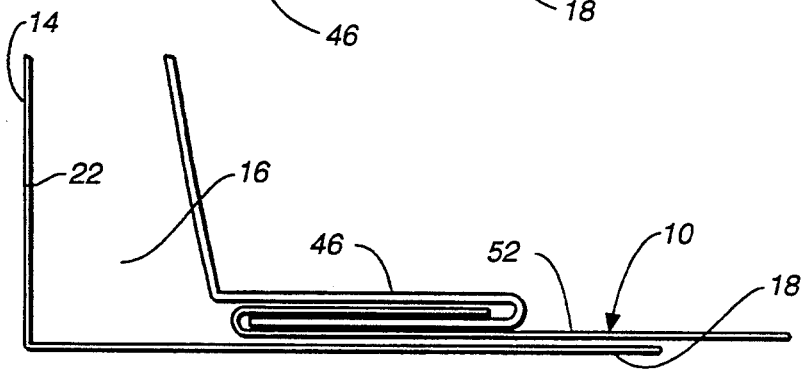
FIG. 4A is an enlarged, partial, schematic view of the area delineated by line 4A—4A in FIG. 4.

FIG. 4A shows a particular type of connection which may exist between the sleeve element side wall distal ends and the sleeve front wall. In this particular arrangement, both the flanges and the outer ends of the sleeve front wall are bent backwardly upon themselves, the distal end thus forming a recess for accommodating the free end of the bent sleeve front wall end and the sleeve front wall end defining a recess for accommodating the free end of the distal end or flange of the sleeve element side wall. This will lock the distal ends 44, 46 in a position spaced from the tray side walls and maintain the curvature of the sleeve element side walls.

In the arrangement illustrated, the sleeve front walls 52, as mentioned above, extend only part way up the sleeve element 30 and thus allow some of the packages 50 to be displayed even during shipping.

Referring now to FIG. 2, in the palletized load including a plurality of the assemblies 10 a top cap 60 is shown extending over the pallet and over all of the product and shipping display assembly sleeve elements positioned on trays on the pallet. The top cap is of unitary construction and is formed of any suitable material such as paperboard. The cap includes an upper cap wall 62 and side cap walls 64 depending from the upper cap wall and encompassing the sleeve elements of all the product shipping and display assemblies positioned on the pallet. An overwrap of plastic film is then applied to the pallet load. Such film may, for example, be heat shrink film which is wrapped and then heated to tightly secure the unit load in place. Strapping (not shown) may be employed instead of or in addition to the overwrap to maintain the assembly 10 in position on the pallet. In FIG. 2 only a portion of the overwrap 68 is shown.

Each assembly can be constructed with ease. For example, the sleeve element can be placed on its rear wall 36 in a jig (not shown). Product can then be loaded in the sleeve element. The sleeve front wall then can be affixed to the sleeve element to form a completed sleeve. The tray 14 is then placed into position and adhesive 38 applied. The unit is then stood upright and moved to a palletizing area. Each assembly is easily removed from its associated pallet by the customer and the front end removed for display. It will be appreciated that this concept lends itself to automation.

Figure 3:
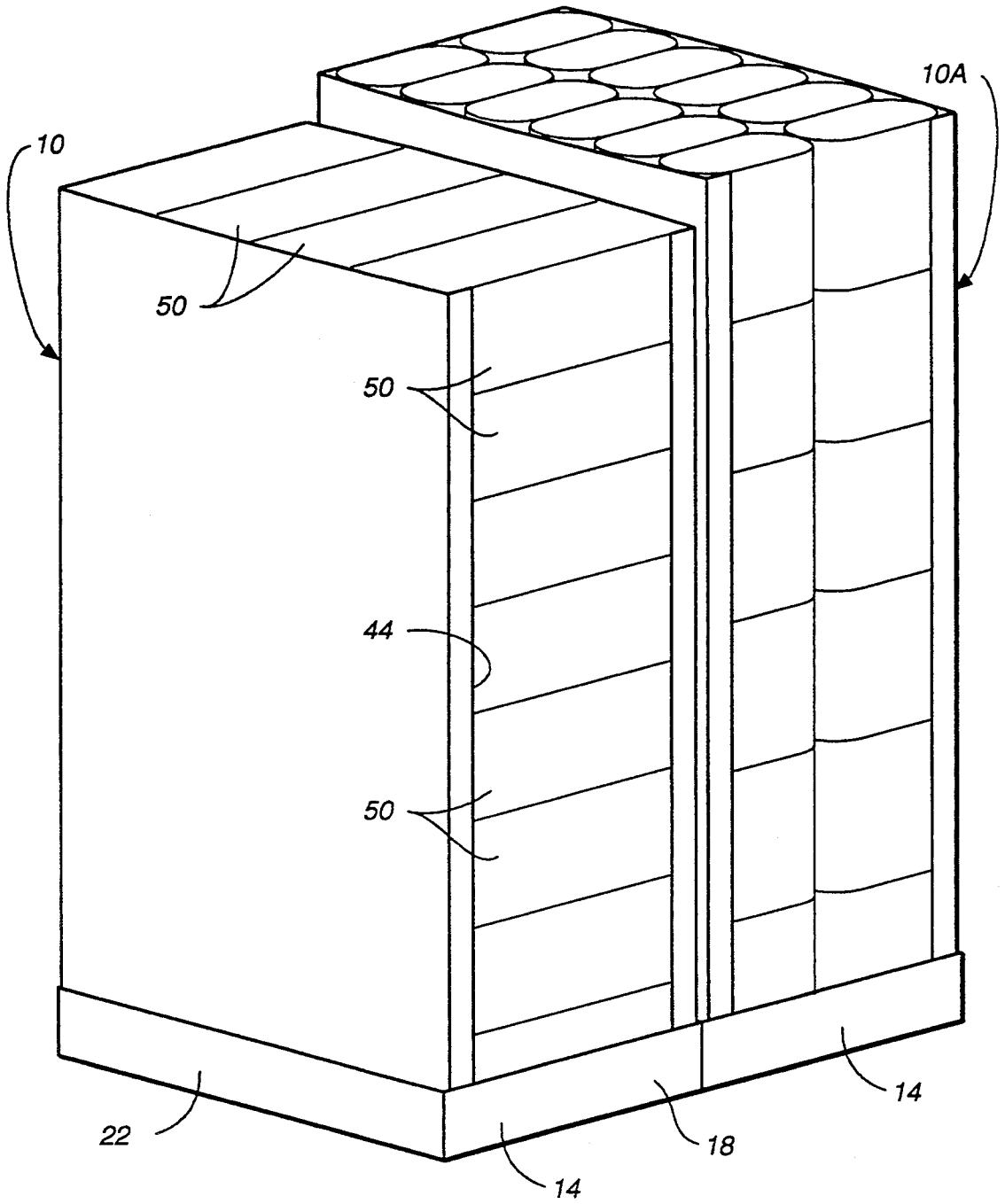
FIG. 3 is a perspective view of two different sized assemblies constructed in accordance with the teachings of the present invention, the assemblies containing different types of products and having the sleeve element front wall of the assembly removed therefrom to expose the products for display and sale.

With the present system, assembly size can vary. For example, FIG. 3 shows an assembly 10A differing in height from assembly 10.

Figure 5:
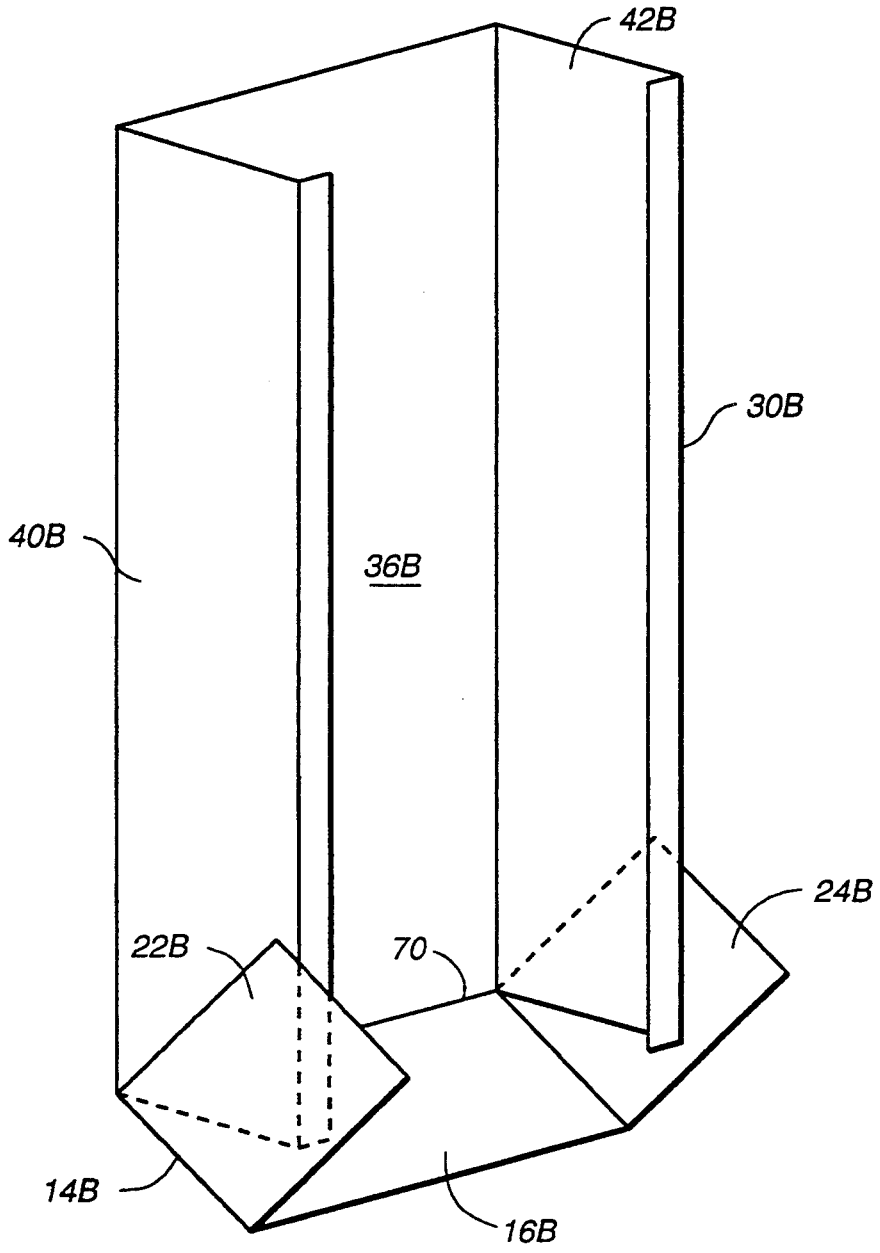
FIG. 5 is a perspective view of an alternate form of assembly constructed in accordance with the teachings of the present invention.

FIG. 5 illustrates an alternative embodiment wherein sleeve element 30B is integrally connected to a tray 14B along hinge line 70. Tray 14B includes a bottom wall 16B and tray side walls 22B, 24B. The sleeve element 30B and tray 14B are formed from a single blank. To assemble this embodiment the tray bottom wall 16B is moved to a position at right angles to the sleeve element rear wall 36B and between sleeve element side walls 40B, 42B. The tray side walls 22B, 24B are then positioned alongside sleeve element side walls 40B, 42B. The sleeve element is thus positioned in the tray interior with the lower end of the sleeve element in engagement with the tray bottom wall.

We claim:

1. A product shipping and display assembly comprising, in combination:

a tray formed of sheet material including a bottom wall of rectangular configuration having a front edge, a rear edge and two spaced side edges extending between said front edge and said rear edge, a front tray wall extending along the length of said front edge and projecting upwardly from said front edge, a rear tray wall extending along the length of said rear edge and projecting upwardly from said rear edge, and spaced tray side walls extending along the lengths of said side edges and projecting upwardly from said side edges, said spaced tray side walls interconnecting said front and rear tray walls at four corners and defining a tray interior therewith;

a sleeve element having upper and lower open ends and formed of sheet material positioned in said tray interior with the lower end of said sleeve element in substantial engagement with said tray bottom wall, said sleeve element including a sleeve element rear wall in engagement with said rear tray wall and two spaced sleeve element side walls extending outwardly from said sleeve element rear wall and along said side tray walls to define a substantially U-shaped sleeve element cross-sectional configuration and a front sleeve element opening extending between said upper and lower ends, said sleeve element rear wall being shorter than said rear tray wall whereby said sleeve element side walls extend outwardly from said sleeve element rear wall at locations spaced inwardly from the corners defined by said rear tray wall and said side tray walls, said sleeve element side walls having distal ends defining said front sleeve element opening extending to locations at said front tray wall spaced inwardly from the tray corners defined by said side tray walls and said front tray wall, and said sleeve element side walls curving outwardly between said sleeve element rear wall and said sleeve element side wall distal ends into engagement with said side tray walls to increase the columnar loading strength of said sleeve element; and a plurality of packages stacked in said sleeve element on said bottom tray wall and extending upwardly from said bottom tray wall along said front sleeve element opening.

2. The product shipping and display assembly according to claim 1 wherein said tray and said sleeve element are secured together by securement means.

3. The product shipping and display assembly according to claim 2 wherein said securement means comprises adhesive adhesively securing said sleeve element rear and side walls to the rear and side tray walls.

4. The product shipping and display assembly according to claim 1 additionally including a sleeve front wall removably connected to said sleeve element side wall distal ends to cover at least a portion of said front sleeve element opening and extending upwardly from said tray element toward said sleeve element upper end, said sleeve front wall defining a gap with said sleeve element upper end communicating with said front sleeve element opening.

5. The product shipping and display assembly according to claim 4 wherein said sleeve element side wall distal ends include flanges in engagement with said front tray wall and with said sleeve front wall.

6. The product shipping and display assembly according to claim 1 additionally comprising a top cap connected to said sleeve element and extending over the upper end of said sleeve element to close said upper end and cover said sleeve element, said top cap having an upper cap wall in partial registry with said tray and substantially larger than said tray bottom wall whereby said top cap can accommodate and cover a plurality of sleeve elements.

7. In combination:

a pallet;

a plurality of product shipping and display assemblies positioned on said pallet, each of said product shipping and display assemblies being in engagement with at least one other product shipping and display assemblies of like character, each said product shipping and display assembly comprising a tray positioned on said pallet formed of sheet material including a bottom wall of rectangular configuration having a front edge, a rear edge and two spaced side edges extending between said front edge and said rear edge, a front tray wall extending along the length of said front edge and projecting upwardly from said front edge, a rear tray wall extending along the length of said rear edge and projecting upwardly from said rear edge, and spaced tray side walls extending along the lengths of said side edges and projecting upwardly from said side edges, said spaced tray side walls interconnecting said front and rear tray walls at four corners and defining a tray interior therewith, a sleeve element having upper and lower ends and formed of sheet material positioned in said tray interior with the lower end of said sleeve element in engagement with said tray bottom wall, said sleeve element including a sleeve element rear wall in substantial engagement with said rear tray wall and two spaced sleeve element side walls extending outwardly from said sleeve element rear wall and along said side tray walls to define a substantially U-shaped sleeve element cross-sectional configuration, a top cap of unitary construction including an upper cap wall extending over said pallet and over all of said product and shipping display assembly sleeve elements positioned on trays on said pallet and side cap walls depending from said upper cap wall and encompassing the sleeve elements of all the product shipping and display assemblies positioned on trays on said pallet, and a plurality of packages stacked in the sleeve elements and on the bottom tray walls of all of the product shipping and display assemblies; and an overwrap at least partially encompassing all of said product shipping and display assemblies and maintaining said product shipping and display assemblies in engagement with each other and said top cap on said sleeve elements of said product and shipping display assemblies.

8. The combination of claim 7 wherein the sleeve element rear wall of each product and shipping assembly on said pallet is shorter than the rear tray wall thereof whereby said sleeve element side walls extend outwardly from the sleeve element rear wall at locations spaced inwardly from the corners defined by said rear tray wall and said side tray walls, said sleeve element side walls having distal ends extending to locations at said front tray wall spaced inwardly from the tray corners defined by said side tray walls and said front tray wall, and said sleeve element side walls curving outwardly between said sleeve element rear wall and said sleeve element side wall distal ends into engagement with said side tray walls to increase the columnar loading strength of said sleeve element.

9. The combination according to claim 8 additionally comprising adhesive adhesively securing the sleeve element rear wall of each product and shipping assembly to a rear tray wall and adhesively securing the sleeve element side walls of each product and shipping assembly to side tray walls.

10. The combination according to claim 7 wherein each product shipping and display assembly on said pallet includes a sleeve front wall removably connected to the sleeve element side wall distal ends.

11. In combination:

a pallet;

a plurality of product shipping and display assemblies positioned on said pallet, each of said product shipping and display assemblies being in engagement with at least one other product shipping and display assemblies of like character, each said product shipping and display assembly comprising a tray positioned on said pallet formed of sheet material including a bottom wall of rectangular configuration having a front edge, a rear edge and two spaced side edges extending between said front edge and said rear edge, and spaced tray side walls extending along the lengths of said side edges and projecting upwardly from said side edges and at least partially defining a tray interior, a sleeve element integral with said tray having upper and lower ends and formed of sheet material, said sleeve element positioned in said tray interior with the lower end of said sleeve element in engagement with said tray bottom wall, said sleeve element including a sleeve element rear wall integrally connected to the tray bottom wall and two spaced sleeve element side walls extending outwardly from said sleeve element rear wall and along said side tray walls to define a substantially U-shaped sleeve element cross-sectional configuration, a top cap of unitary construction including an upper cap wall extending over said pallet and over all of said product and shipping display assembly sleeve elements positioned on trays on said pallet and side cap walls depending from said upper cap wall and encompassing the sleeve elements of all the product shipping and display assemblies positioned on trays on said pallet, and a plurality of packages stacked in the sleeve elements and on the bottom tray walls of all of the product shipping and display assemblies; and an overwrap at least partially encompassing all of said product shipping and display assemblies and maintaining said product shipping and display assemblies in engagement with each other and said top cap on said sleeve elements of said product and shipping display assemblies.

* * * * *